United States Patent [19]

Abbott

[11] 3,948,453

[45] Apr. 6, 1976

[54] RIBBON BREAKING MACHINE

[75] Inventor: Samuel L. Abbott, Wilton, N.H.

[73] Assignee: Abbott Machine Co., Inc., Wilton, N.H.

[22] Filed: Aug. 8, 1973

[21] Appl. No.: 386,777

[52] U.S. Cl. ..... 242/35.5 R; 242/18.1
[51] Int. Cl. ..... B65h 54/20; B65h 54/38
[58] Field of Search ..... 242/35.5 R, 35.5 A, 35.6 R, 242/18.1, 18 DD, 18 R

[56] References Cited

UNITED STATES PATENTS

| | | | |
|---|---|---|---|
| 2,135,485 | 11/1938 | Abbott | 242/35.5 R |
| 3,033,478 | 5/1962 | Furst | 242/35.6 R |
| 3,434,673 | 3/1969 | Brouwer et al. | 242/18.1 |

FOREIGN PATENTS OR APPLICATIONS

| | | | |
|---|---|---|---|
| 898,038 | 6/1962 | United Kingdom | 242/18 DD |
| 1,138,335 | 1/1969 | United Kingdom | 242/18 DD |

*Primary Examiner*—Stanley N. Gilreath
*Attorney, Agent, or Firm*—Robert T. Gammons

[57] ABSTRACT

In a machine for winding yarn to form a package, a winding drum supported in engagement with the package for traversing yarn from end-to-end as it is wound, a drum wheel for effecting rotation of the drum, a traction roll and brake shoe supported for movement relative to the drum wheel, on the one hand to engage the traction roll with the drum wheel and simultaneously disengage the brake shoe therefrom and, on the other hand, to disengage the traction roll from the drum wheel and engage the brake shoe therewith, a drive shaft for driving the traction wheel constantly, and mechanism for intermittently oscillating the traction roll and brake shoe relative to the drum wheel while maintaining engagement of the traction roll in driving engagement with the means for driving the traction roll. A pivotally supported package arm supports the package in engagement with the winding drum, a roller is supported in engagement with the brake shoe by one arm of the bell crank and a spring stretched in tension with one end connected to the support arm and the other to the other arm of the bell crank applies pressure to the package which decreases with the increase in size of the package and pressure to the brake which increases with the size of the package.

27 Claims, 10 Drawing Figures

RIBBON BREAKING MACHINE

BACKGROUND OF THE INVENTION

Winding yarn to form a package is accomplished by means of a winding drum or cam which traverses the yarn back and forth along the length of the package to effect a uniform distribution of the yarn. There is a tendency during such winding operations for ribbons to form on the surface, that is, for the adjacent turns of the yarn to bunch. Such formation is particularly apt to take place in the harmonic areas where the turns usually begin to change from an open to a closed pattern, the turns coming closer and closer together and finally piling on top of each other and then reversing. In my U.S. Pat. Nos. 3,416,741 and 3,140,836, there are shown winding machines in which a drum or cam is employed to package yarn and wherein to minimize the occurrence of such ribbon formation mechanism has been provided to periodically disengage the traction roll from the drum or cam so as to allow the drum to slow down and then re-engage the traction roll with the drum to speed it up and in this way break up the continuity of the winding operation and the formation of ribbon. A similar effect may be obtained by accelerating the drum against the package at intervals and this may be achieved by periodically shutting off the current to a motor which drives the drum and then turning it on. In the high-speed winding machines which are currently used the method of breaking up ribbon formation by disengaging the traction roll from the drum wheel or stopping the drive motor and restarting it as mentioned above is largely ineffective because of the inertia in the rotating masses which within the intervals of discontinuing the drive and reassuming the drive nullifies any slow down and speed up of sufficient magnitude to break up the ribbon forming tendencies. The apparatus as shown herein is designed to enable substantially complete break-up of ribbon formation in spite of high-speed winding with a minimal redesign of the present winding apparatus, without thread breakage and with a minimal loss of power.

SUMMARY

A winding machine of the kind in which a package is wound by a rotating drum which traverses the yarn from end-to-end, first means for rotating the drum, second means for slowing down rotation of the drum and means for intermittently simultaneously applying the first means and disabling the second means and simultaneously disabling the first means and applying the second means. The first means is movable into and out of driving relation with the drum and the second means is movable into and out of breaking relation with the drum. There is a drum wheel at one end of the drum and the first means comprises a traction roll supported for movement into and out of engagement with the drum wheel. The braking means comprises a brake shoe supported for movement into and out of engagement with the drum wheel and there is means supporting the traction roll and brake shoe so that when one is moved into operative position the other is retracted from operative position. The means for effecting intermittent engagement and disengagement of the traction roll and the brake shoe comprises a linkage mounting the traction roll and brake shoe for oscillation about a horizontal axis parallel to the axis of the drum which is supported by the winding head for movement along the frame of the machine and uniformly spaced pins on the frame operable by intercepting the linkage to intermittently effect its operation. The mechanism is oscillated approximately 3 times every 2 seconds and the brake force applied is approximately one-half the drive torque employed. The traction roll is yieldably held against the drum wheel by spring means and there is means for increasing the spring pressure from a predetermined low pressure at the beginning of rotation of the package to a predetermined maximum pressure when the rotation of the drum and the package are the same. While the device is illustrated specifically with respect to travelling winding heads it can be readily employed with a stationary winding head by providing means for intermittently actuating the linkage; for example, a driven cam or a time-controlled reciprocable plunger. There is means for applying pressure to the package supporting arm for pressing the package against the winding drum which decreases in proportion to the increase in size of the package, and means for applying pressure to the brake shoe for pressing it against the winding drum which increases in proportion to the increase in size of the package.

The invention will now be described in greater detail with reference to the accompanying drawings wherein.

Figure 2:
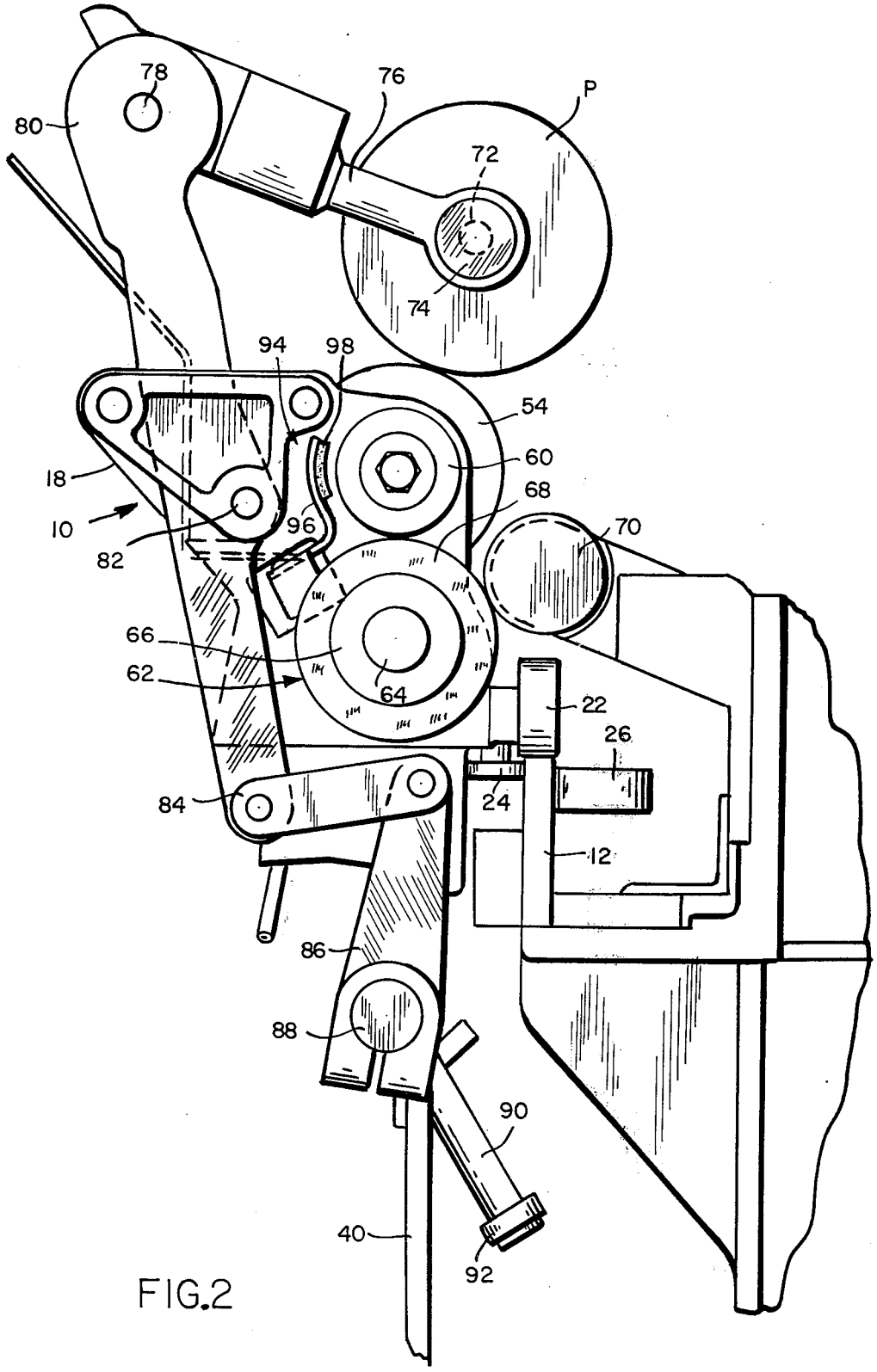
FIG. 2 is a fragmentary elevation of the winding head shown in FIG. 1, to much larger scale, taken from the rear side of FIG. 1.
Figure 9:
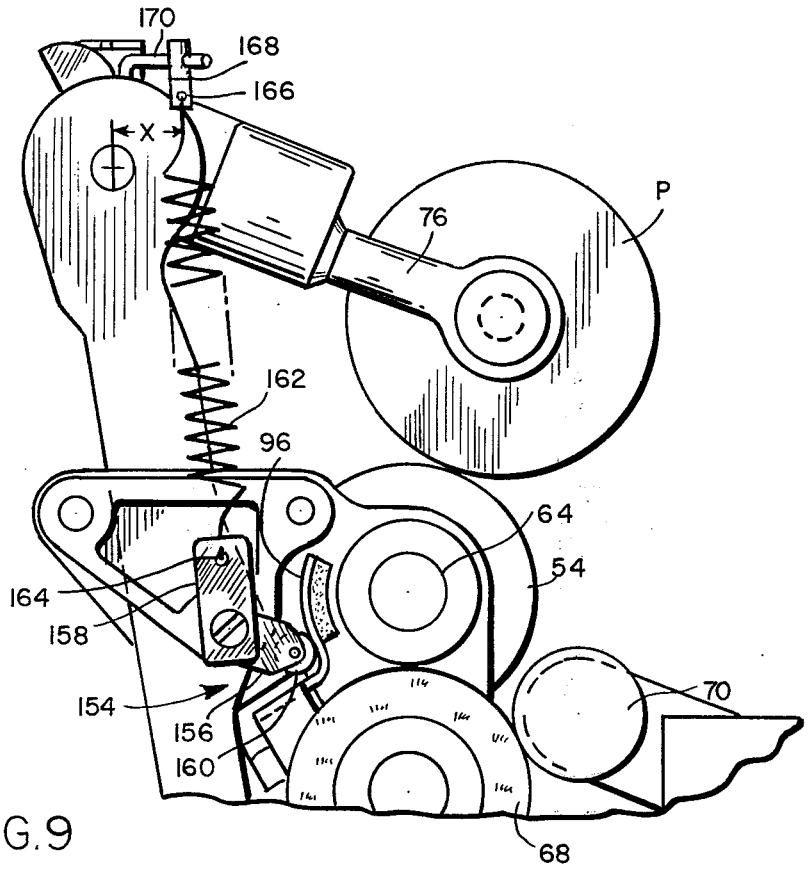
Figure 10:
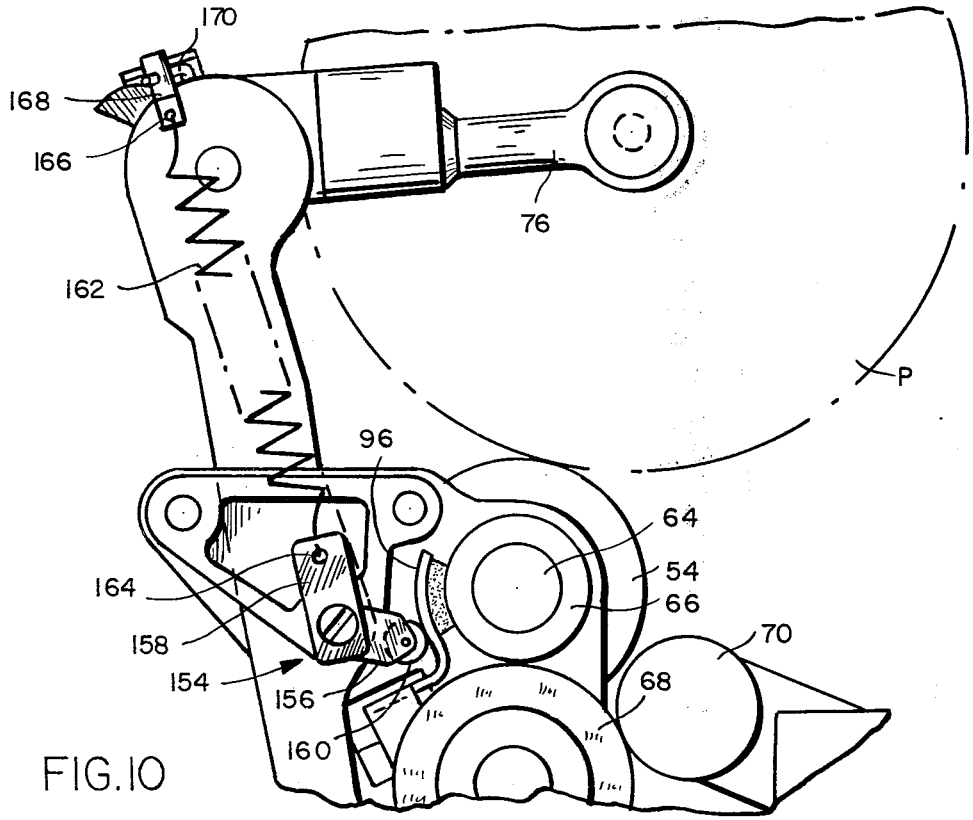

FIG. 9 is a side view of the apparatus similar to that shown in FIG. 2, showing the package-supporting arm in depressed position, modified to provide means for applying spring pressure to the package arm in a direction to press the package against the winding drum and simultaneously to apply pressure by way of a bell crank lever and roller engaged with the brake shoe to apply pressure to the brake shoe in a direction to press it against the winding roll; and FIG. 10 is a view similar to FIG. 9 showing the elevated position of the package arm and the means for pressing the package and the brake shoe against the winding drum.

The invention is illustrated in conjunction with an automatic winding machine of the type having a plurality of winding units or heads, each adapted to wind thread from a supply onto a bobbin and having automatic tending mechanism constructed to operate on the winding heads in succession as by travel of the winding heads past the tending mechanism — such a machine being illustrated in U.S. Pat. No. 2,659,538.

Figure 1:
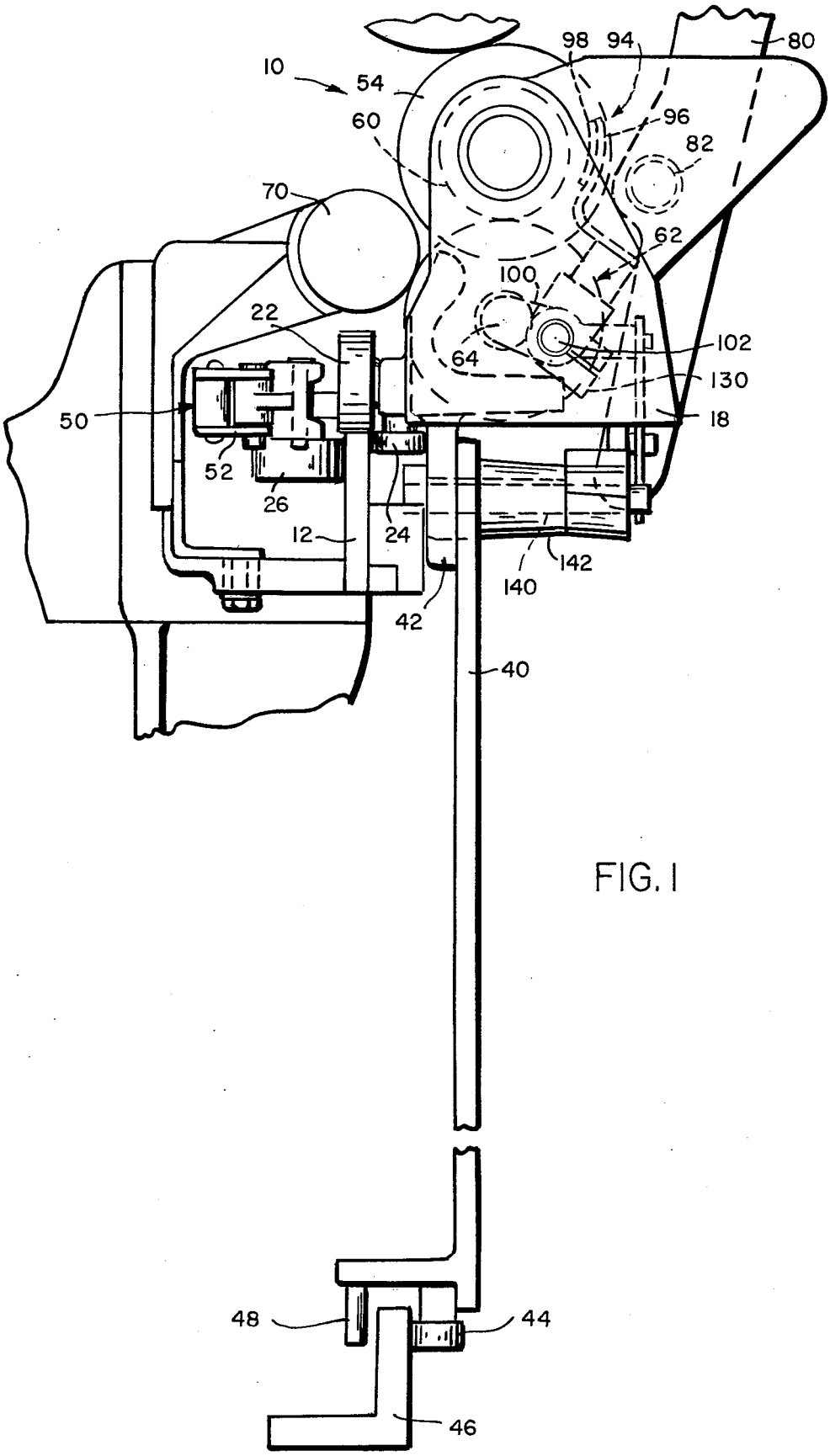
FIG. 1 is a fragmentary elevation showing one head of a winding machine of the kind comprising a plurality of winding heads supported on a rail for movement therealong relative to automatic tending mechanism.
Figure 3:
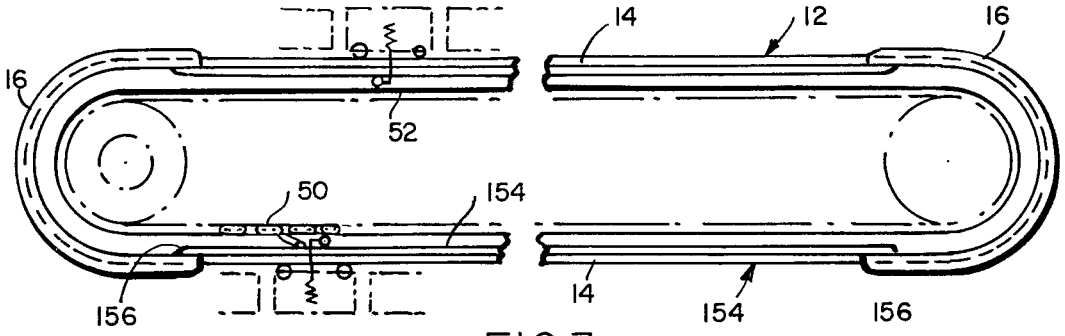
FIG. 3 is a plan view of the configuration of the track defining the path of travel along which the winding heads travel.
Figure 4:
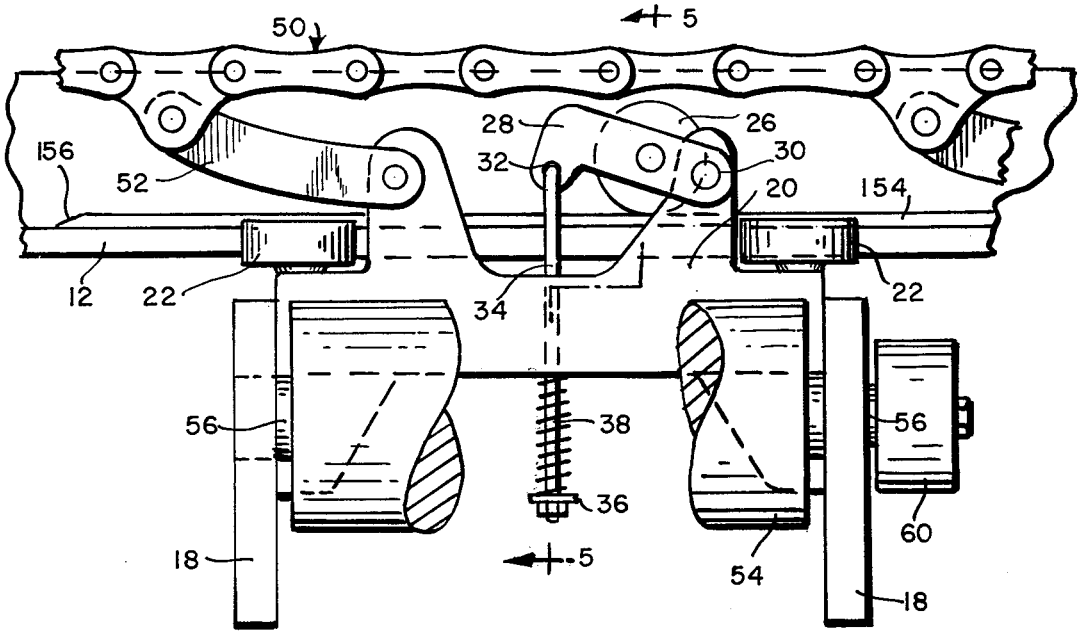
FIG. 4 is a fragmentary plan, to larger scale, showing the means for traversing the winding head and for holding it on the rail.
Figure 5:
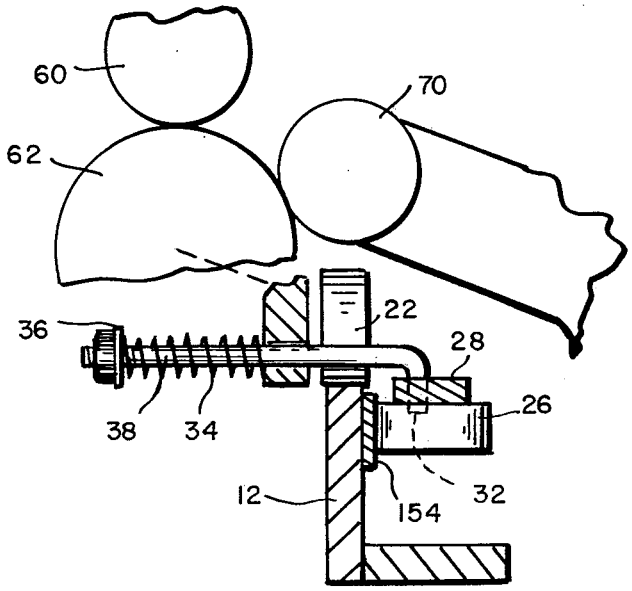
FIG. 5 is a section taken on the line 5—5 of FIG. 4.

Since the winding units or heads are identical the description will be confined for the most part to the construction and operation of the mechanism for breaking up ribbon of a single winding head 10 shown in elevation in FIGS. 1 and 2 respectively, from the left side (FIG. 1) and the right side (FIG. 2) supported on a rail 12 for movement along a predetermined generally rectangular path (FIG. 3) having spaced parallel straight courses 14—14 connected at their ends by curved courses 16—16. Each head comprises spaced parallel, vertically disposed bearing plates 18—18 rigidly connected to a horizontally disposed carriage plate 20 (FIG. 4), the latter being mounted on the upper edge of the rail 12 by means of longitudinally spaced rollers 22—22 which engage the top of the rail, longitudinally spaced rollers 24—24 which engage the forward side of the rail and a roller 26 which engages the rear side of the rail. The roller 26 is rotatably mounted on an arm 28 (FIG. 4), one end of which is pivotally connected at 30 to the carriage plate and the other end of which is connected to one end 32 of a rod 34 which extends forwardly through the carriage plate and has mounted on its forward end between a nut 36 mounted on the rod and the forward edge of the carriage plate a spring 38. To steady the movement of the unit along the rail 12 as it travels along the track and around the ends a leg 40 (FIG. 1) is secured at its upper end to a bracket 42 at the underside of the carriage plate which has at its lower end a roller 44 which engages the outer side of a second rail 46 and a pin 48 disposed opposite the inner side of the rail 46.

Figure 6:
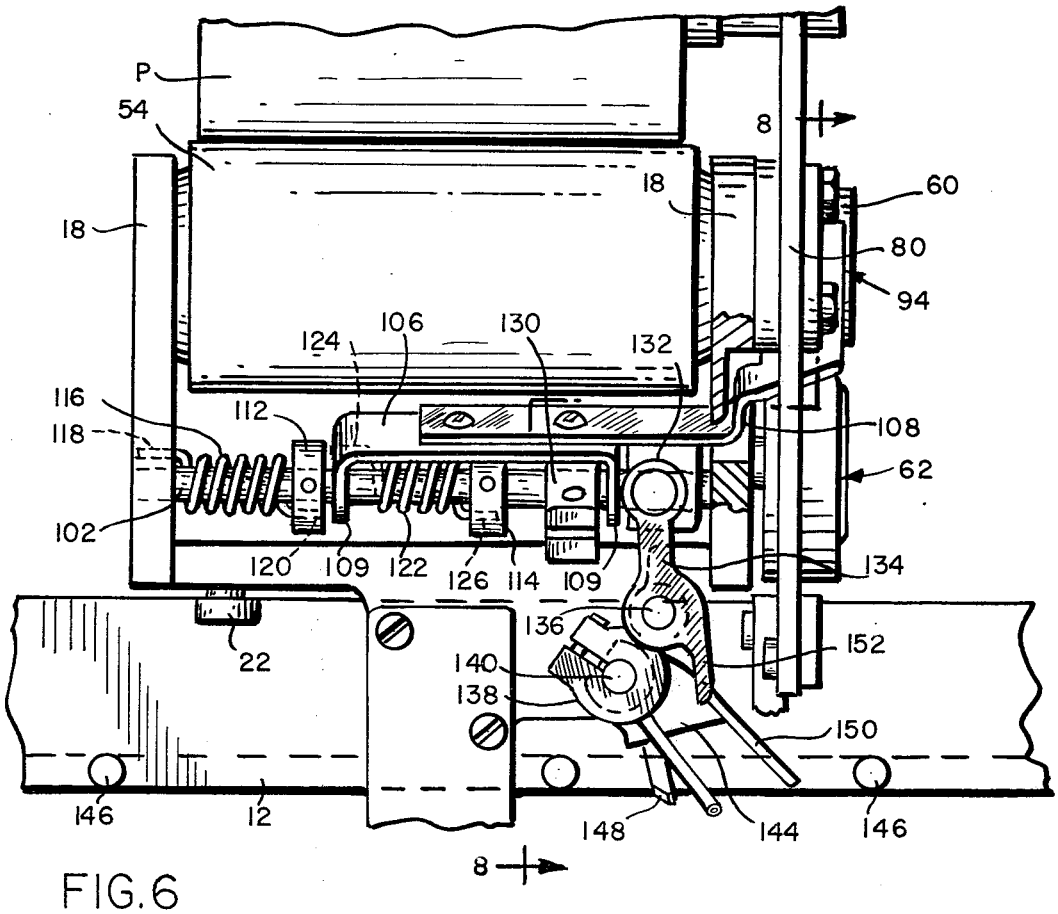
FIG. 6 is a fragmentary elevation, broken away in part, showing the mechanism for effecting operation of the traction roll and brake shoe.
Figure 7:
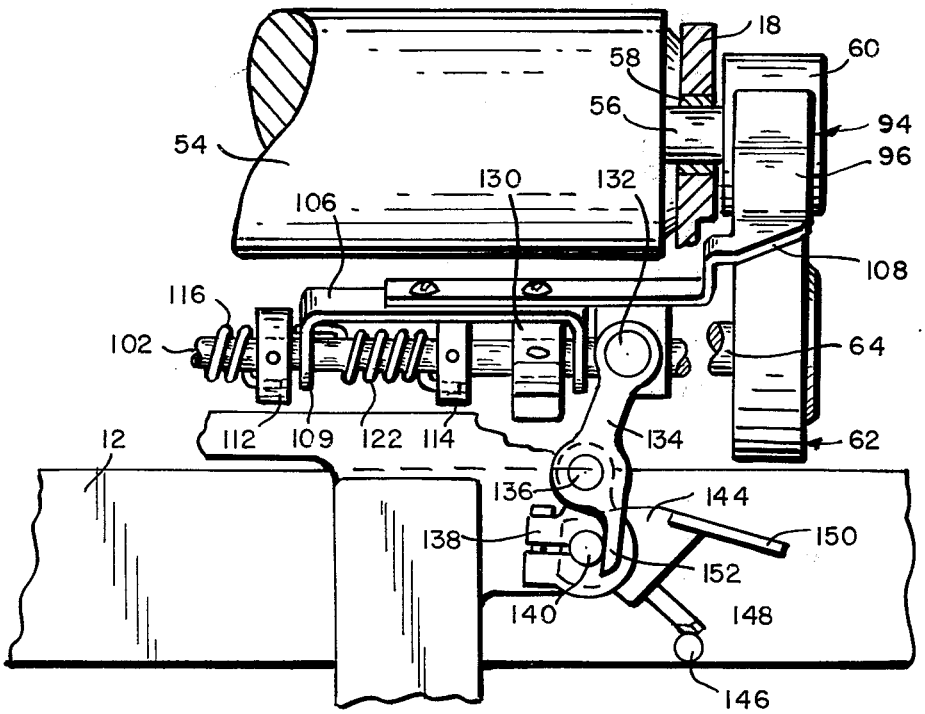
FIG. 7 is a view like FIG. 6 showing the mechanism in fully braked position.

The heads are traversed along the courses 14—14 and 16—16 by a conveyor chain 50 (FIG. 4) to which there are connected drag links 52, the links 52 in turn being connected to the carriage plates 20. A winding drum or cam 54 is mounted between the bearing plates 18—18 for rotation about a horizontal axis on stub shafts 56—56 which extend through antifriction bearings 58—58 (FIGS. 6 and 7) in the end plates. The stub shaft 56 at the right end, as shown in FIGS. 6 and 7, has fast to it a drum pulley or wheel 60. The winding drum 54 may contain a helical traversing groove for receiving a yarn and guiding it along the length of the bobbin upon which the yarn is to be wound or to effect reciprocation of a guide element through which the yarn passes for the same purposes. Each of the aforesaid means for effecting such traversing movement of the yarn is commonly employed in the art and hence does not require further description — for example, see U.S. Pat. No. 1,911,047.

The winding drum 54 is driven by a traction roll 62 (FIG. 2) which is, as will appear hereinafter, intermittently moved into and out of engagement with the drum pulley 60 to effect at time rotation of the drum pulley 60 and at other times to discontinue the rotation. The traction roll 62 is mounted on a shaft 64 with its peripheral surface aligned with the peripheral surface of the drum pulley 60. The traction roll 62 is of the kind shown in the aforesaid patent comprising a rigid core piece 66 on which there is mounted a cork tire 68. The traction roll is mounted so that in either position of engagement or disengagement with respect to the drum pulley 60 it has continuous engagement with a drive shaft 70, the latter, as shown in the patented machine, comprising an elongate shaft extending lengthwise of the courses 14—14 on the frame of the machine and constantly driven so that as the heads travel along the courses rotation of the drive shaft 70 imparts continuous rotation of the traction roll of each of the winding heads.

The package of yarn P is formed by winding the yarn on a core piece such as a spindle 72 supported at one end in a bearing member 74 (FIG. 2) at the end of an arm 76 pivotally supported at 78 on the upper end of a post 80 for pivotal movement about the axis of the pivot 78 from an upright retracted position to a downwardly inclined position of engagement of the spindle, and of the package as it is wound, with the surface of the drum. The post 80 is pivotally supported intermediate it ends on a pivot 82 fixed to the bearing plate at the left side of the machine, as shown in FIG. 2. The lower end of the post 80 is connected to one end of a link 84, the opposite end of which is connected to one end of an arm 86. The other end of the arm 86 is clamped to a shaft 88. An arm 90 is also clamped to the shaft 88 and is provided with a roller 92 by means of which it is rocked at times to move the package forwardly away from the drum during an end finding operation and to return it when the end finding operation is completed.

As has been previously related one of the problems in winding yarn onto a spindle is that of ribbon formation, that is, bunching of adjacent coils of yarn which if it becomes pronoucned results in sluffing of the yarn from the package. Such ribbon formation can be broken up to a degree by changing the rate of rotation of the package and this, as described above, has been achieved by periodically disengaging the traction roll from the drum so as to allow the package to slow down and re-engaging it so as to speed it up to its normal speed of rotation. With the high-speed winding operation now used this procedure is not sufficiently effective because the inertia of the parts is such that they do not slow down fast enough to break up the ribbon and if time is afforded for such slow down the high-speed winding operation which is sought on such machines is lost. It has been found, according to this invention, that disengaging the traction wheel from the drum accompanied by a positive braking action applied to the drum, as herein illustrated, by applying a brake shoe 94 against the surface of the drum wheel 60 will break up and minimize ribbon formation. The brake shoe 94 (FIGS. 2 and 8) comprises an arcuate-shaped plate 96, to the inner concave side of which is attached a cork pad 98 for frictional engagement with the drum wheel.

Figure 8:
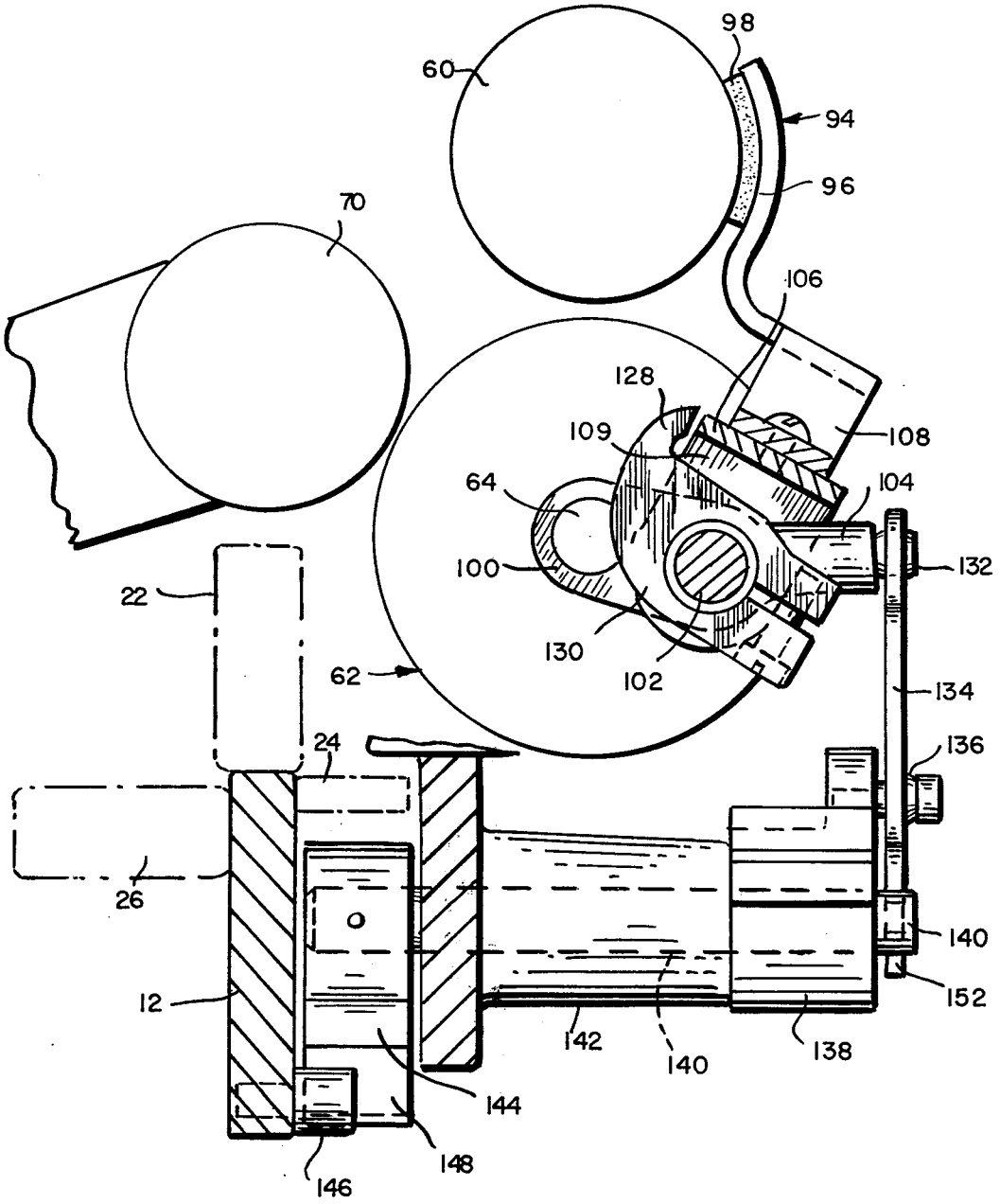
FIG. 8 is a fragmentary elevation, partly in section, taken on the line 8—8 of FIG. 6.

The traction roll 62 and the brake shoe 94, as previously mentioned, are supported for movement, respectively, into and out of engagement with the drum wheel 60. The support for the traction roll comprises the shaft 64 (FIG. 8) and is mounted at one end of an arm 100, the opposite end of which is clamped to a shaft 102 which is parallel to the axes of rotation of the drum and drive roll and at such distances therefrom that rotation of the arm 100 about the axis of the shaft 102 will separate the surface of the traction roll 62 from the drum wheel 60 without disengaging it from the drive roll 70. The arm 100 has an extension 104. A bracket member 106 (FIGS. 6 and 7) is rotatably mounted on the shaft 102 and the brake shoe 94 is attached to this bracket by a bracket arm 108. The bracket member 106 is C-shaped, having at its opposite ends legs 109—109 rotatably mounted on the shaft 102. The shaft 102 is rotatably mounted at its ends in the bearing plates 18—18 and has fixed to it two collars 112 and 114, the collar 112 being situated between one end of the bracket and the plate 18 at the left side, as shown in FIG. 6, and the collar 114 being fixed to the shaft between the legs of the bracket. A coiled spring 116 is mounted about the shaft 102 with one end engaged in an opening 118 in the plate 18 and the other end with an opening 120 in the collar 112. A second coil spring 122 is mounted around the shaft 102 with one end fixed in a hole 124 in the leg 109 at the left end of the bracket and its other end fixed in a hole 126 in the collar 114. The springs operate to yieldably urge the brake shoe in a direction to engage the surface of the drum pulley by biasing the bracket member 106 in a counterclockwise direction, as shown in FIG. 8. A toe 128 (FIG. 8) on a clamp 130 is clamped to the shaft 102 and is operable by engagement with the bracket member 106 when the arm 100 is rotated in a clockwise direction about the axis of the shaft 102 to rotate the bracket member in a clockwise direction to disengage the brake from the drum pulley.

To be effective for high-speed operation it has been found desirable to engage and disengage the traction wheel and disengage and engage the brake shoe about three times every two seconds of rotation when, for example, rotation is in the order of 2000 to 2200 RPM. Oscillation of the shaft 102 to effect this is achieved by linkage comprising a ball connection 132 (FIG. 8) connecting one end of a link 134 to the extension 104. The other end of the link 134 is pivotally connected by a ball connection 136 to a clamp 138 fast to one end of a shaft 140 rotatably supported in a bearing 142. A plate 144 is mounted on the other end of the shaft 140 adjacent the rail 12. Pins 146 are mounted at uniformly spaced intervals along the rail 12 in a position such that as the winding heads travel along the rail the plate 144 moves along just above the pins 146. The plate 144 has on it a finger 150. Between pins 146 the plate 144 occupies the position shown in FIG. 6 in which the finger 150 extends downwardly between the pins. As the head travels along the rail the pins 146 intercept the finger 150 thus rocking the shaft 140 in a counterclockwise direction. Such counterclockwise rotation withdraws the traction roll 62 from the drum pulley 60 and applies the brake shoe 94 thereto. As the finger 150 passes a pin 146 the coil springs return the linkage to the position shown in FIG. 6 which, in turn, reapplies the traction wheel to the surface of the drum wheel and retracts the brake shoe therefrom. A finger 148 shown in FIGS. 6 and 7 is also attached to the shaft 140 and is normally held retracted so that it is not intercepted by the pins 146. This finger is moved into operative position to fully apply the brake in response to a yarn detector upon yarn breakage.

The device thus constructed is very effective for breaking up ribbon formation in high-speed operation and without loss of winding speed or power since the spring pressure applied by the brake shoe need not be very great to accomplish the desired result. A braking force of approximately one-half the drive torque has been found quite satisfactory.

The slowing down of the drum, of course, requires that it be brought up to speed again and if the speed-up is too slow scrambling or freakish winding will result, that is, the angle of wind will be increased to an extent where the yarn will not lie flat on the package and at its maximum results in slippage.

It is important therefore to get the drum back up to its original speed as fast as possible and this can only be accomplished by insuring good contact between the drive roll and the traction roll. Such contact can be obtained by turning the nut 36 approximately one-fourth inch along the rod so as to apply pressure to the spring 38 and thus increases the pressure between the traction roll and the drive roll sufficiently to cut down the time for the drum to come up to speed from zero with a medium package from one second to a half a second.

It has also been found that when the winding operation is started at each end of the machine there is a tendency for scramble to take place on the face of the package. This is caused by the drum accelerating too fast against the face of the package which is limited in its acceleration by its own coefficient of friction and inertia characteristics. Accordingly, it is desirable to start the winding operation at a slower rate in these areas so that the drum and package can speed up together with little or no relative change in their surface velocity.

Both maximum contact between the traction roll and the drive roll and slow start up in the end areas is preferably provided for by cam bars 155—155 (FIGS. 3 and 4) disposed along the inner sides of the rails 12 on which the heads travel. The cam bars comprise strips of metal about 3/32 of an inch thick and 1 inch wide. Rearward displacement of the roller 26 by engagement with the cam bars by the amount of 3/32 of an inch increases the pull on the spring 38 by depressing it almost 2½ to 1 or about one-fourth inch as would be accomplished by rotating the nut 36 one-fourth inch on the bar 38. With the use of the cam bars what happens is that at the ends of the frame where the packages start up when the traction roll first contacts the drive roll, the spring is relatively relaxed and allows a slow start up from the drum to the package. The ends of the cam bars are beveled at 156—156 and after a short travel the roll 26 rides up on the cam bar, tightening up the spring 38 and this increases the pressure between the traction roll and drive wheel which in turn brings up the speed fast enough to eliminate ribbon formation.

The apparatus has been described as operating through an application of the driving force and the braking force directly to the drum. However, it is entirely within the scope of this invention to apply the driving forces and braking forces directly to the package or to the spindle on which the package is supported.

It is advantageous to apply a lesser braking force to the winding drum when the package is small because the lack of inertia in the small package allows the winding drum and associated parts to decelerate too fast or if the package is large not fast enough and thus it would be convenient to have means for relating the package size to the brake force applied to the winding drum.

It also would be advantageous to have a greater amount of pressure between the package and the winding drum when it is small than when it is large, on the one hand to stop scrambling and on the other hand to stop bouncing of the package which is very apt to happen particularly during the early stages of the winding of the package.

Both of these desired measures have been achieved as illustrated in FIGS. 9 and 10 by mounting a bell crank lever 154 having arms 156 and 158 adjacent the brake shoe 96 for angular movement about a horizontal axis parallel to the axis of the winding drum 54 with the arm 156 supporting a roller 160 in engagement with the brake shoe and with a coiled spring 162 supported in tension with one end 164 connected to the arm 158 of the bell crank lever and the other end 166 attached by means of an adjustably mounted coupling element 168 to a spring arm 170 pivotally mounted on the package arm 76 for swinging movement of the arm about one end on a radius through the center of pivotal movement of the arm 76. FIG. 9 shows the structure at the beginning of a package winding operation in which the package-supporting arm 76 is depressed and the spring is applying a force coupled to the package-supporting arm represented by the line X. As the package increases in size the package arm 76 moves upwardly about its pivot axis, stretching the spring as shown in FIG. 10, thereby increasing the pressure of the roller 160 against the brake shoe as the size of the package increases and simultaneously moving the axis of the spring means from the forward side of the pivot axis of the package arm to the rear side, as shown in FIG. 10 — the consequence of which is that the force couple decreases to zero or to a negative force so that the pressure applied to the package arm as the package increases in size decreases in proportion to the increase in size. The pressures applied by the spring 162 are applied constantly throughout the intermittent application of the driving and braking forces applied to the winding drum explained above.

It should be understood that the present disclosure is for the purpose of illustration only and that this invention includes all modifications and equivalents falling within the scope of the appended claims.

I claim:

1. A winding machine of the kind in which a package is wound by a rotating drum, a drum wheel at one end of the drum, a traction roll supported for movement into and out of engagement with said drum wheel, spring means yieldably holding the traction roll engaged with the drum wheel, a drive shaft for constantly driving the traction roll, a traction brake supported for movement into and out of engagement with the drum wheel and means for continuously throughout any winding operation alternately simultaneously engaging the traction roll and disengaging the traction brake and simultaneously disengaging the traction roll and engaging the traction brake, spring means for yieldably holding the traction roll engaged witih said drive shaft and means for increasing the spring pressure from a predetermined low pressure at the beginning of the rotation of the package to a predetermined maximum when the rotation of the drum and the package are the same.

2. Apparatus according to claim 1, wherein the traction roll has a cork tire on it and the brake has a cork brake shoe.

3. Apparatus according to claim 1, wherein the traction roll and the traction brake are actuated approximately 3 times every 2 seconds.

4. Apparatus according to claim 6, wherein a braking force of approximately one/half the driving torque is employed.

5. Apparatus according to claim 1, wherein the traction roll is yieldably held against the drum wheel.

6. A winding machine of the kind comprising a track, a plurality of winding heads mounted on the track and means for traversing the winding heads along a predetermined path relative to an automatic tending station and wherein each winding head embodies a rotating drum for traversing yarn as it is wound upon the package, and a coaxial drum wheel; a continuously drive shaft extending along the path of movement of the winding heads, a traction roll associated with each winding head, means associated with each winding head for supporting the traction roll in driving enagement with the drive shaft and for movement to engage and disengage the traction roll from the drum wheel without interrupting the drive between the traction roll and the drive shaft, a brake shoe, means mounting the brake shoe for movement in unison with the traction roll to engage it with the drum wheel when the traction roll is disengaged therefrom and vice versa, and means situated along said path to in one position increase the driving friction between the traction roll and the drive shaft from a predetermined low to a predetermined higher pressure and in another position to decrease the driving friction from said predetermined higher pressure to said predetermined low pressure.

7. A winding machine of the kind comprising a track, a plurality of winding heads, a carriage supporting each winding head on the track for movement therealong relative to an automatic tending station and a drive shaft, and wherein each winding head embodies a rotating drum for traversing yarn as it is wound to form a package, a coaxial drum wheel, a traction roll, means supporting the traction roll in sliding engagement with the drive shaft and for movement to engage and disengage the traction roll from the drum wheel while maintaining the traction roll in uninterrupted driving engagement with the drive shaft, a brake shoe, means mounting the brake shoe for movement in unison with the traction roll to engage the brake shoe with the drum wheel when disengaging the traction roll therefrom and vice versa, a cam bar extending along the track, and means mounting the carriage on the track including a yieldably mounted roller engaged with the track, said cam bar being in a position to be engaged by the roller and to increase the friction between the traction roll and drive shaft while engaged with the cam bar.

8. A winding machine according to claim 7, wherein the ends of a cam bar are beveled so that the friction between the traction roll and the drive shaft is increased and decreased at the opposite ends at the one end from a predetermined low pressure to a predetermined higher pressure and at the other end from said predetermined higher pressure to said predetermined low pressure.

9. In a winding machine in which a plurality of winding heads travel along a track relative to automatic tending means, a continuously rotating drive shaft paralleling said track, each head comprising a drum for winding yarn on a spindle, a traction wheel for effecting rotation of the drum, and means for yieldably holding the traction wheel in driving engagement with the drive shaft; means situated along the track for increasing the frictional engagement of the traction wheel with the drive shaft from a predetermined low pressure at the beginning of any winding operation at one end of the machine to a predetermined maximum as the rate of rotation of the drum and package reach the same speed.

10. In a winding machine in which a plurality of winding heads travel along a track relative to automatic tending means, a constantly rotating drive shaft paralleling said track, each head comprising a drum for winding yarn on a spindle, and a traction wheel for effecting rotation of the drum said heads being supported on said track for movement therealong by rollers engaged with the top, front and rear sides and said rollers at the rear side being yieldably held engaged with the track by spring means, and wherein cam bars are fastened to the track at the rear side which extend lengthwise thereof from end-to-end in a position such that the spring pressed rollers are displaced rearwardly as they travel along the cam bar to increase the friction between the traction wheel and the drive shaft.

11. Apparatus according to claim 10, wherein the ends of the cam bars are beveled.

12. A winding machine of the kind in which a package is wound by a rotating drum, which traverses the yarn from end-to-end, first means for rotating the drum, second means for slowing down rotation of the drum, means for intermittently and simultaneously applying the first means and disabling the second means and simultaneously disabling the first means and applying the second means, and means for applying pressure to the second means which decreases in proportion to the increase in size of the package.

13. A winding machine of the kind in which a package is wound by a rotating drum, which traverses the yarn from end-to-end, first means for rotating the drum, second means for slowing down the rotation of the drum, means for intermittently simultaneously applying the first means and disabling the second means and simultaneously disabling the first means and applying the second means, means for constantly applying pressure between the package and the drum which decreases in proportion to the increase in size of the package, and means for applying pressure to the second means which increases in proportion to the increase in size of the package.

14. In a winding machine, a winding drum, a driven traction roll associated with the drum supported for movement into and out of engagement therewith while continuing to be driven, a brake shoe supported adjacent the winding drum movable into engagement with the winding drum simultaneously with the disengagement of the traction roll therewith and vice versa, means for effecting intermittent engagement of the brake shoe and disengagement of the traction roll, and intermittent disengagement of the brake shoe and engagement of the traction roll and spring means operating on the brake in a direction to press the brake when applied against the winding drum and for applying said pressure in direct proportion to the increase in diameter of the package.

15. In a winding machine, a winding drum, a driven traction roll associated with the drum supported for movement into and out of engagement therewith while continuing to be driven, a brake shoe supported adjacent the winding drum movable into engagement with the winding drum simultaneously with the disengagement of the traction roll therefrom and vice versa, means for effecting intermittent engagement of the brake shoe and disengagement of the traction roll and vice versa, a package-supporting arm pivotally supported for movement relative to the drum as the package increases in size, spring means operating on said arm in a direction to press the package against the winding drum for applying pressure in inverse proportion to the increase in diameter of the package, spring means operating on the brake in a direction to press the brake against the drum when the latter is applied and for applying pressure in direct proportion to the increase in diameter of the package.

16. A winding machine according to claim 15, wherein said spring means operates simultaneously to apply pressure to the package arm and to the brake.

17. In a winding machine, a winding drum, a driven traction roll associated with the winding drum for movement into and out of engagement therewith while continuing to be driven, said winding drum and traction roll being mounted on spaced parallel, horizontally disposed shafts, a package arm, a spindle mounted at one end of the package arm with its axis parallel to the winding drum, a support arm pivoted intermediate its ends for angular movement about an axis parallel to the winding drum, means pivotally connecting the other end of the package arm to the support arm, said package arm being angularly movable about its pivoted end relative to the winding drum as the package being wound increases in diameter, said support arm being pivotally movable to move the package forwardly relative to the winding drum, a drive shaft with which the traction roll is held engaged, means for retracting the traction roll from driving engagement with the winding drum without disengaging it from the drive shaft, a brake shoe supported for movement into and out of braking engagement with the winding drum, means for simultaneously retracting the traction wheel and applying the brake shoe and vice versa, and a spring, stretched in tension, connected at one end to the package arm intermediate the pivoted end thereof and the end to which the spindle is mounted operating to bias the package arm in a direction to press the forming package against the winding drum.

18. In a winding machine, a winding drum, a driven traction roll associated with the winding drum for movement into and out of engagement therewith while continuing to be driven, said winding drum and traction roll being mounted on spaced parallel, horizontally disposed shafts, a package arm, a spindle mounted at one end of the package arm with its axis parallel to the winding drum, a support arm pivoted intermediate its ends for angular movement about an axis parallel to the winding drum, means pivotally connecting the other end of the package arm to the support arm, said package arm being angularly movable about its pivoted end relative to the winding drum as the package being wound on the spindle increase in diameter, said support arm being pivotally movable to move the package downwardly relative to the winding drum, a drive shaft, means for retracting the traction roll from driving engagement with the winding drum without disengaging it from the drive shaft, a brake shoe supported for movement into and out of braking engagement with the winding drum, means for simultaneously retractiing the traction roll and applying the brake shoe and vice versa, a bell crank pivotally mounted to rock about an axis parallel to the axis of the winding drum with one arm adjacent the brake shoe, a roll mounted on said one arm in engagement with the brake shoe, and a spring stretched in tension with one end connected to the other one of the bell crank arms, said spring operating to apply pressure to said brake shoe.

19. In a winding machine, a winding drum, a driven traction roll associated with the winding drum for movement into and out of engagement therewith while continuing to be driven, said winding drum and traction roll being mounted on spaced parallel, horizontally disposed shafts, a package arm, a spindle mounted at one end of the package arm with its axis parallel to the winding drum, a support arm pivoted intermediate its ends for angular movement about an axis parallel to the winding drum, means pivotally connecting the other end of the package arm to the support arm, said package arm being angularly movable about its pivoted end relative to the winding drum as the package being wound on the spindle increases in diameter, said support arm being pivotally movable to move the package forwardly relative to the winding drum, a drive shaft, means for retracting the traction roll from driving engagement with the winding drum without disengaging it from the drive shaft, a brake shoe supported for movement into and out of braking engagement with the winding drum, means for simultaneously retracting the traction roll and applying the brake shoe and vice versa, a bell crank pivotally mounted to rock about an axis parallel to the axis of the winding drum with one arm adjacent the brake shoe, a roller mounted on said one arm in engagement with the brake shoe, and a spring stretched in tension with one end connected to the other arm of the bell crank and its other end connected to the package arm in such a position that as the package arm rises with the increase in diameter of the package the tension in the spring is increased and the effective length of the arm is decreased.

20. In a winding machine, a winding drum, a driven traction roll associated with the winding drum for movement into and out of engagement therewith while continuing to be driven, a package arm pivotally mounted for angular movement relative to the winding drum, a spindle at the distal end of the package arm supported thereby for engagement with the winding drum, a brake shoe supported for movement into and out of braking engagement with the winding drum, means for simultaneously retracting the traction roll and applying the brake shoe and vice versa, a bell crank supported for angular movement about an axis parallel to the axis of the winding drum with one arm adjacent the brake shoe, a roller mounted on said one arm in engagement with the brake shoe, a spring arm mounted on the package arm adjacent its pivoted end, and a spring connected in tension between said spring arm and the other arm of the bell crank such that as the package increases in size, moving the package arm upwardly about its pivoted end, the axis of the spring is moved from the forward side of the pivot axis of the package arm to a position rearwardly thereof, and the end of the spring attached to the spring arm travels upwardly relative to the end attached to the arm of the bell crank along an arc of predetermined radius about said pivot axis.

21. In a traveling winding machine wherein there are a plurality of winding assemblies, a track supporting the assemblies for movement along a predetermined path and wherein each assembly embodies a rotatable drum for winding yarn to form a package, first means for rotating the drum, second means for slowing down rotation of the drum, and means spaced along the track operable as the assemblies travel along the said predetermined path to intermittently simultaneously actuate the first means and de-actuate the second and simultaneously de-actuate the first and actuate the second throughout the winding operation.

22. Apparatus according to claim 21, comprising a constantly rotating drive shaft, said first means comprising a traction roll supported in engagement with said drive shaft, a spring uring the traction roll against the drive shaft and cam means on the track operable to withold the full compressive engagement of the spring until the rotation of the traction roll corresponds to that of the drive shaft.

23. In a winding machine, a winding drum, a driven traction roll associated with the drum supported for movement into and out of engagement therewith while continuing to be driven, means for effecting said movement of the traction roll, a brake shoe supported adjacent the winding drum movable into engagement with the winding drum simultaneously with the disengagement of the traction roll therefrom and vice versa, means for effecting movement of the brake shoe and means yieldably applying pressure to the brake shoe so that the pressure between the brake shoe and the winding drum increase in proportion to the increase in size of the package.

24. In a winding machine a winding drum, a driven traction roll associated with the drum, supported for movement into and out of engagement therewith while continuing to be driven, means for effecting said movement of the traction roll, a brake shoe supported adjacent the drum movable into and out of engagement with the winding drum simultaneously with the disengagement of the traction roll therefrom and vice versa, means for effecting movement of the brake shoe, a package supporting arm for supporting a package to be wound into engagement with the winding drum, means yieldably applying pressure to the arm in a direction to hold the forming package against the winding drum so that the pressure between the forming package and the drum is decreased in proportion to its increase in size, and means yieldably applying pressure to the brake shoe so that the pressure between the brake shoe and the winding drum increases in proportion to the increase in size of the package.

25. The method of winding yarn, comprising supporting a core member on which the package is to be formed in engagement with a driving drum provided with traversing means and a coaxial drive wheel by means of which the drum is rotated and hence the yarn is traversed from end to end, supporting a traction wheel in driving engagement with a constantly rotating drive shaft and while continuing to hold the traction wheel in driving engagement with the drive shaft moving the traction wheel about the axis of the drive shaft to alternately engage the traction wheel with the drive wheel and disengage it therefrom and simultaneously alternately applying a braking torque to the drive wheel and releasing the braking torque in timed relation with the engagement and disengagement of the traction wheel.

26. The method of winding yarn on a spindle, wherein a rotating drum is employed to effect rotation of the package for winding of the yarn thereon, a drive shaft is employed to provide the driving torque and a traction roll held against the drive shaft and the drum is employed to transmit the torque from the drive shaft to the drum, comprising lightly holding the traction wheel engaged with the drive shaft at the beginning of the winding operation and increasing the frictional engagement between the traction wheel and the drive shaft to a maximum at the top speed of the winding operation.

27. The method of winding wherein a drum is employed to rotate the package for winding of a yarn thereon, a drive shaft is employed to provide the driving torque and a traction roll held against the drive shaft and the drum is employed to transmit the torque from the drive shaft to the drum, comprising yieldably holding the traction roll in engagement with the drive shaft during the start of the winding operation at a predetermined low pressure such as to avoid scramble on the surface of the package and increasing the frictional engagement of the traction roll with the drive shaft as the drum and package come up to speed to a predetermined maximum such as to avoid ribbon formation.

* * * * *